US010766642B2

(12) United States Patent
Martin

(10) Patent No.: US 10,766,642 B2
(45) Date of Patent: Sep. 8, 2020

(54) METHOD AND APPARATUS FOR AUTOMATICALLY PACKAGING AND DISPENSING FOOD PRODUCTS

(71) Applicant: F.R. DRAKE COMPANY, Waynesboro, VA (US)

(72) Inventor: Gregg A. Martin, Charlottesville, VA (US)

(73) Assignee: F.R. Drake Company, Waynesboro, VA (US)

( * ) Notice: Subject to any disclaimer, the term of this patent is extended or adjusted under 35 U.S.C. 154(b) by 0 days.

(21) Appl. No.: 15/945,874

(22) Filed: Apr. 5, 2018

(65) Prior Publication Data

US 2018/0290777 A1 Oct. 11, 2018

Related U.S. Application Data

(60) Provisional application No. 62/482,975, filed on Apr. 7, 2017.

(51) Int. Cl.

| | |
|---|---|
| ***B65B 11/10*** | (2006.01) |
| ***B65B 11/02*** | (2006.01) |
| ***B65B 65/00*** | (2006.01) |
| ***B65B 63/04*** | (2006.01) |
| ***B65B 5/04*** | (2006.01) |
| ***F25D 19/00*** | (2006.01) |
| ***B65B 61/00*** | (2006.01) |
| ***B65B 25/06*** | (2006.01) |
| ***F25D 25/04*** | (2006.01) |
| *B65B 35/24* | (2006.01) |
| *B65B 9/067* | (2012.01) |

(52) U.S. Cl.

CPC ..... *B65B 11/105* (2013.01); *B65B 5/04* (2013.01); *B65B 11/02* (2013.01); *B65B 25/06* (2013.01); *B65B 61/005* (2013.01); *B65B 63/04* (2013.01); *B65B 65/006* (2013.01); *F25D 19/00* (2013.01); *F25D 25/04* (2013.01); *B65B 9/067* (2013.01); *B65B 35/24* (2013.01); *B65B 2220/06* (2013.01); *B65B 2220/18* (2013.01)

(58) Field of Classification Search

CPC ..... B65B 11/105; B65B 5/04; B65B 11/02; B65D 83/08; B65D 2583/005

USPC ..... 73/818; 221/71

See application file for complete search history.

(56) References Cited

U.S. PATENT DOCUMENTS 3,274,746 A * 9/1966 James ..... B65B 31/04 53/433

3,989,853 A * 11/1976 Forkner ..... A23G 3/0294 426/305

(Continued)

*Primary Examiner* — Rakesh Kumar

(74) *Attorney, Agent, or Firm* — Berenato & White, LLC

(57) ABSTRACT

A food product gathering and dispensing system is disclosed. The food product is generally a flat disc shaped article dispensed onto a consumable strip of food product conveyer material. The food product is fed to single, or series related, spools that wind up the consumable conveyer material and food product into a removable roll. The roll is placed into a dispenser pack, optionally subject to further environmental treatment, and refrigeration. The pack is then installed within a refrigerated dispenser system where the food product and consumable material are collectively unwound and separated, as the food product is fed into a processing system, i.e., a cooking device. The consumable conveyer material is collected and separately discarded.

8 Claims, 4 Drawing Sheets

(56) References Cited

U.S. PATENT DOCUMENTS 4,663,915 A * 5/1987 Van Erden ..... B65B 9/073 493/214
4,792,457 A * 12/1988 Brna ..... B65B 9/12 426/129
4,841,712 A * 6/1989 Roou ..... B65B 9/02 156/248
4,876,842 A * 10/1989 Ausnit ..... B29C 66/98 53/410
4,907,393 A * 3/1990 Omori ..... B65B 61/20 53/128.1
5,247,781 A * 9/1993 Runge ..... B65B 61/188 53/412
6,925,779 B2 * 8/2005 Thieman ..... B65B 9/06 53/412
7,509,787 B2 * 3/2009 Ballestrazzi ..... B65B 9/06 53/411
7,694,499 B2 * 4/2010 Ballestrazzi ..... B65B 11/585 53/545
7,763,298 B2 * 7/2010 Archibald ..... B32B 27/06 426/414
8,621,831 B2 * 1/2014 Moylan ..... B65B 5/04 53/168
9,436,770 B2 * 9/2016 Hattrup ..... G06F 16/9554
2002/0079400 A1 * 6/2002 Fujiwara ..... B65H 18/10 242/523.1
2002/0116903 A1 * 8/2002 Otsu ..... A45D 40/0087 53/440
2003/0072853 A1 * 4/2003 Murray ..... A23G 3/0236 426/132
2003/0208988 A1 * 11/2003 Buckley ..... B65B 61/02 53/411
2005/0097966 A1 * 5/2005 Sartain ..... G01N 3/40 73/818
2005/0123435 A1 * 6/2005 Cutler ..... A23L 3/001 422/1
2008/0245923 A1 * 10/2008 Maddaleni ..... B65H 19/2269 242/610.1
2010/0062196 A1 * 3/2010 Bezek ..... B32B 27/06 428/35.2
2011/0139363 A1 * 6/2011 Hebert ..... B32B 27/32 156/268
2013/0276655 A1 * 10/2013 Palmatier ..... B65H 39/075 101/483
2015/0348446 A1 * 12/2015 Kiyotomo ..... G09F 3/10 428/189
2018/0025185 A1 * 1/2018 Hattrup ..... G06Q 10/0833 235/375
2018/0290777 A1 * 10/2018 Martin ..... B65B 25/06
2018/0312284 A1 * 11/2018 Ternes ..... B65B 9/087
2019/0039764 A1 * 2/2019 Mallya ..... B65B 51/06
2019/0039765 A1 * 2/2019 Mallya ..... B65B 51/06

* cited by examiner

METHOD AND APPARATUS FOR AUTOMATICALLY PACKAGING AND DISPENSING FOOD PRODUCTS

CROSS-REFERENCE TO RELATED APPLICATIONS AND CLAIM TO PRIORITY

This application claims the benefit of provisional application Ser. No. 62/482,975, filed Apr. 7, 2017, the disclosures of which are incorporated herein by reference.

FIELD OF THE INVENTION

The present invention relates to a method and associated apparatus for automatically placing food product into a rolled or otherwise gathered package, a so-called a "Dispenser Pack". The Dispenser Pack is then used for storage, specialized environmental treatment, and shipping and/or can be otherwise integrated into a package system containing a plurality of the rolled or otherwise similarly gathered food products. At the site that receives the Dispenser Pack, the rolls, or otherwise gathered food products, can be attached to a machine for automatically dispensing the food products according to the needs of the receiving site. The food products may be disc-like food products, preferably unfrozen food products such as hamburger patties, sausage patties, vegetable patties and any other similarly generally flat and typically disc-shaped food products.

BACKGROUND OF THE INVENTION

Producers in the food industry are under pressure to remain competitive by reducing cost. One known method for reducing cost is to reduce the number of workers and replace them with automated systems to the greatest extent possible.

In addition, food producers must keep their food products clean and sanitary for human consumption. Studies have shown, for example, that any time some human touches an object many thousands of microbes are unwittingly transferred to the object. Therefore, eliminating any human contact with food is a significant way to potentially reduce the number of microbes present with a food product and thus increase food safety. A system that eliminates human contact with a food product is highly desirable.

SUMMARY OF THE INVENTION

This invention is a system having three major parts: the Gathering System, used to fill Dispenser Packs; the Dispenser Pack itself; and, the Dispensing System for unloading the Dispenser Pack on location. Each part will be explained individually, which will ultimately describe the whole system. The Gathering and Dispensing systems are separate units that typically can/will be in different locations.

Gathering System

The purpose of the Gathering System is to collect an inflow of food products that are presented from a processing station via a consumable conveyor belt. The consumable conveyor belt becomes part of the overall package or Dispenser Pack. The Gathering System then arranges the food products more compactly for ease of storing and transporting thereafter. One such method is to roll up the food products along with the consumable belt on which the food products are presented into a large roll that may then be deposited, such as by a robot, into a package, such as the Dispenser Pack.

The Gathering System keeps track of the number of food products being gathered using a sensor or counter disposed above or adjacent the conveyor belt. When the desired count is reached, the Gathering System is stopped and the complete Dispenser Pack spool is cut, such as by a knife or like blade capable of severing the conveyor belt, detached from the Gathering System, and placed into a shipping container or other means for transporting the complete Dispenser Pack. Alternatively, an extendable output conveyor may be used to buffer the food products for a short period while the rolls automatically change.

A new blank or empty Dispenser Pack spool is then automatically inserted into the Gathering System and the process starts again for that specific feed of food product.

All of these tasks are done robotically without the need for any direct or indirect human contact with the food or surfaces on which the food is placed.

Dispenser Pack

The Dispenser Pack serves two purposes. The first purpose is to hold the compactly arranged food products in such a way that the Dispenser Pack and its food products can be easily stored and transported. The second purpose is to be able to be automatically loaded as well as automatically dispensed into the desired process for that specific food product, again without the need for human contact with the food product. The Dispenser Pack may be a corrugated cardboard container or the like that is appropriately sized to hold the roiled conveyor belt with its food products.

The Dispenser Pack has an integral spindle/spool that is also a functional part of the dispensing system. The spindle fits over a mandrel in the dispensing system, or is otherwise operably connected to the dispensing system in order to allow the conveyor belt and its food products to be unwound as necessary. The mandrel may or may not be powered. The spindle serves as the mechanism to transmit torque from the powered mandrel to the spool portion to assist the winding/unwinding process.

Dispensing System

The purpose of the Dispensing System is to have the ability to be loaded with a Dispenser Pack and then automatically dispense the contained food products in the desired speed and frequency for any manner of further processing. With a minimal amount of work and with no human contact with the food products, Dispenser Packs can be loaded and unloaded from the Dispensing System.

The Dispensing System may include a refrigeration system and an insulated exterior structure capable of maintaining temperature of internal food product below 40 degrees F. This temperature assures food safety, particularly for non-frozen food products, and also maintains the firmness of the Dispenser Pack and allows it to function properly with the Dispensing system.

DETAILED DESCRIPTION OF THE PREFERRED EMBODIMENT

Figure 1:
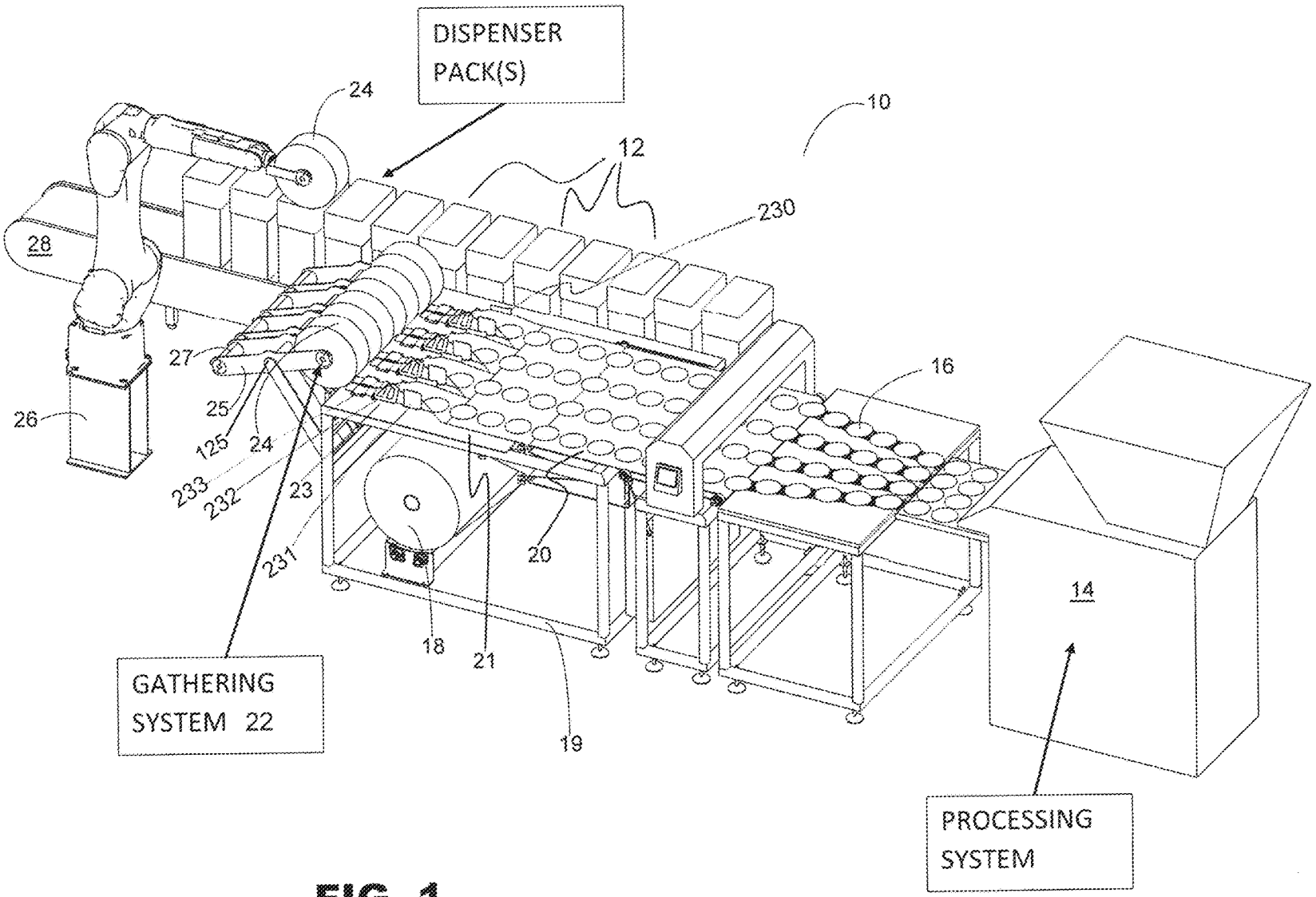
FIG. 1 is an oblique view of the overall food product unit gathering system.

The operation of the Gathering System 10 is as follows:

Food products 16 are fed to the Gathering System spool end 22 on a consumable conveyor belt 20 that is suitable for the food products 16 being gathered. The consumable conveyor belt in this case is a conveyor belt 20 that can be detached or cut from the processing system 14, and become part of the Dispenser Pack 12. The conveyer material 20 is fed and cut from a supply roll 18, in this case placed beneath the gathering system conveyer bed 21 and within frame 19.

The Gathering System 10 collects the food products 16 and by rolling onto spool(s) 24, or folding or any other process, which captures the food product in a compact manner at end 22 which is then placed on conveyor 28 within a Dispenser Pack 12 that itself can be removed from the system 10 for transport. The Gathering System spool end 22 includes a series of pivoting frames elements 25, pivoting at mounting 125, that are configured to mount spools 24, at either end of the pivoting frame element 25 on mandrel(s) 27. As a spool 24 is filled, an empty spool is mounted onto the mandrel 27 opposite the filled spool, the pivoting frame member 25 is pivoted about 125 so as to simultaneously enable removal of the filled spool and the replacement of it in the filling position with an empty spool. The filled spool 24 is then removed by robot 26 and placed into an awaiting empty dispenser pack 12 while the newly positioned replacement spool is filled.

Figure 1A:
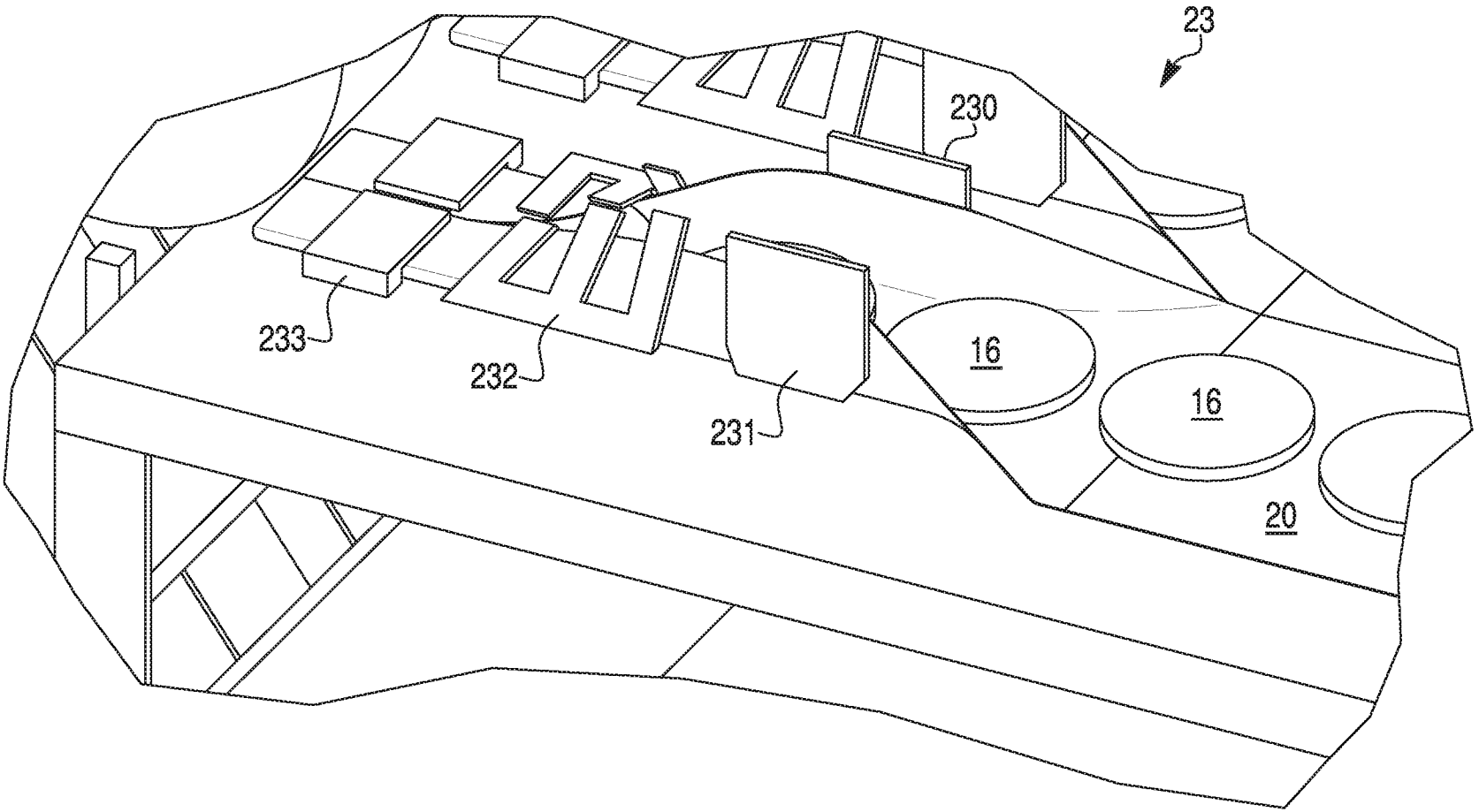
FIG. 1A shows details of the folding device 23 shown in FIG. 1.
Figure 2B:
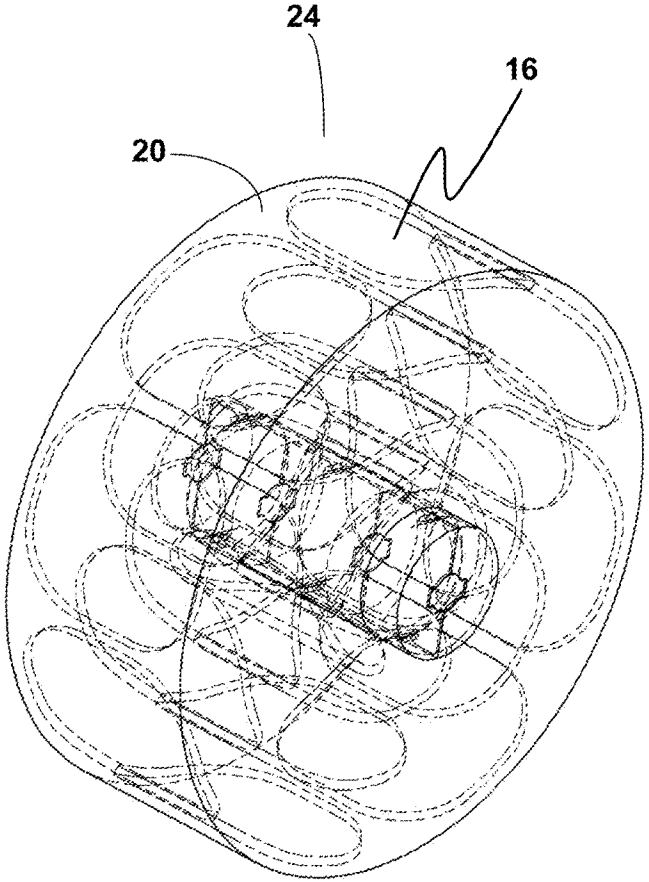
FIG. 2B is a partially transparent view of a spindle or spool of food product gathered in accord with the present invention.

The Gathering system belt folding device 23 here is shown in FIG. 1A using excess belt width from conveyer 20, having the parallel cut longitudinal opposed edges, of adjacent feed tracks (if more than one is present), initially folded upwardly by opposed elements 230 and 231 and then folded again by successive finger elements in an E-shaped folder element 232 having progressively folded fingers elements folding towards the conveyor bed 21 at smaller angles, one edge toward the other, and laid over the top surfaces of successive food product units 16 by final folding element 233 thereby completely encapsulating the food products in an extended "tube" structure of folded conveyor 20 material. The food units 16 are thereby covered top and bottom in successive layered windings of conveyor 20, as shown in FIG. 2B, as they are wound in this covering of conveyor 20 onto the spool 24.

The Gathering System 10 counts the incoming food products and when a programmable pre-determined number is reached it will stop, and also signal upstream equipment to stop if necessary. Once the Gathering System is stopped, the Gathering System cuts the consumable conveyor 20 with its collected and counted food products 16, and closes the folded end of the consumable belt 20 to keep food products 16 from falling off the spool 24.

The Gathering System 10 robotic machine 26 then replaces a spool 24 with an empty one that has been pre-loaded onto the system. This can be done manually, or automatically, but is preferably free from human contact. Once the empty spools 24 are in place, the Gathering System splices, via a heat cutter/sealer, for example, associated with folder 23, the end of the consumable conveyor belt 20 or belts to the new empty spool 24. Consumable belts can be made of a material, i.e., food grade plastic film, that can be heat fused, or by some other method, joined to the leading edge of an empty spool 24. A preferred material for the conveyor belt 20 is a polyethylene film that is approximately 0.005 inches thick and twelve (12) inches wide. The film should not be too elastic because the rolled belt 20 and food products 16 would, in that event, be excessively tight and distort the food products 16. Coated paper may also be used. The material of the conveyor belt 20 should also have good release properties so that the food products 16 do not stick to the belt 20, particularly during removal. The full spools are unloaded and new blanks loaded, as noted previously, while the newly attached spools are being loaded.

Dispenser Packs

Figure 2A:
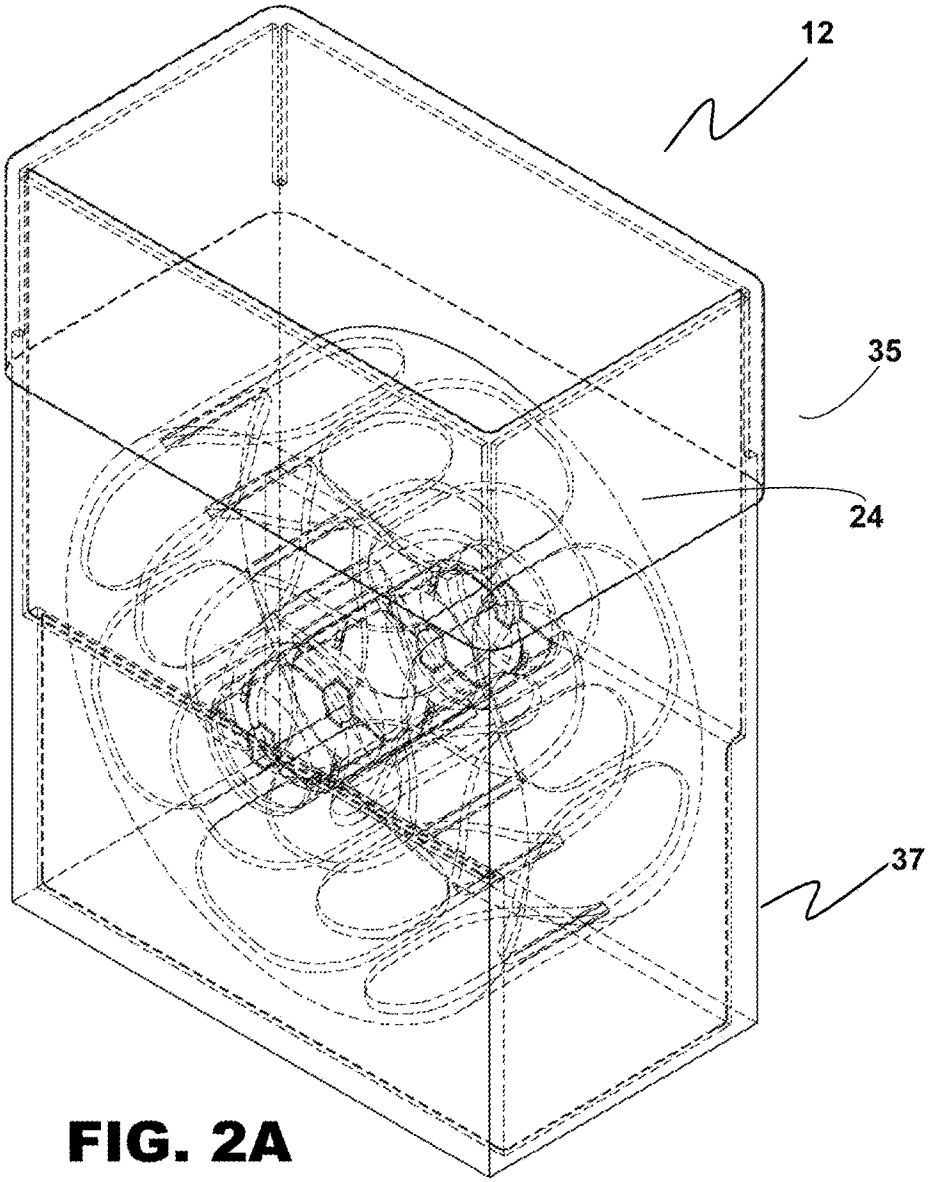
FIG. 2A is partially transparent view of a dispenser pack in accord with the present system.

As shown in FIGS. 2A and 2B, Dispenser Packs 12 are units of food product 16 that are collected on the consumable belt 20 and arranged in a compact manner, wherein food product 16 is contained between successive layered windings of the consumable conveyor 20 around a contained spool 24. The Dispenser Pack 12 can be automatically loaded and unloaded and the food products 16 within each Dispenser Pack 12 container box 35 (top)/37 (bottom) can be transported and/or sealed in a suitable larger package as needed.

The Dispenser Packs 12 are also configured so that they either can be individually provided, or grouped into an even larger container, and that the container can also go through a modified atmosphere packaging process or MAP, i.e., oxygen removal using nitrogen or another purge gas.

Dispensing System

Figure 3:
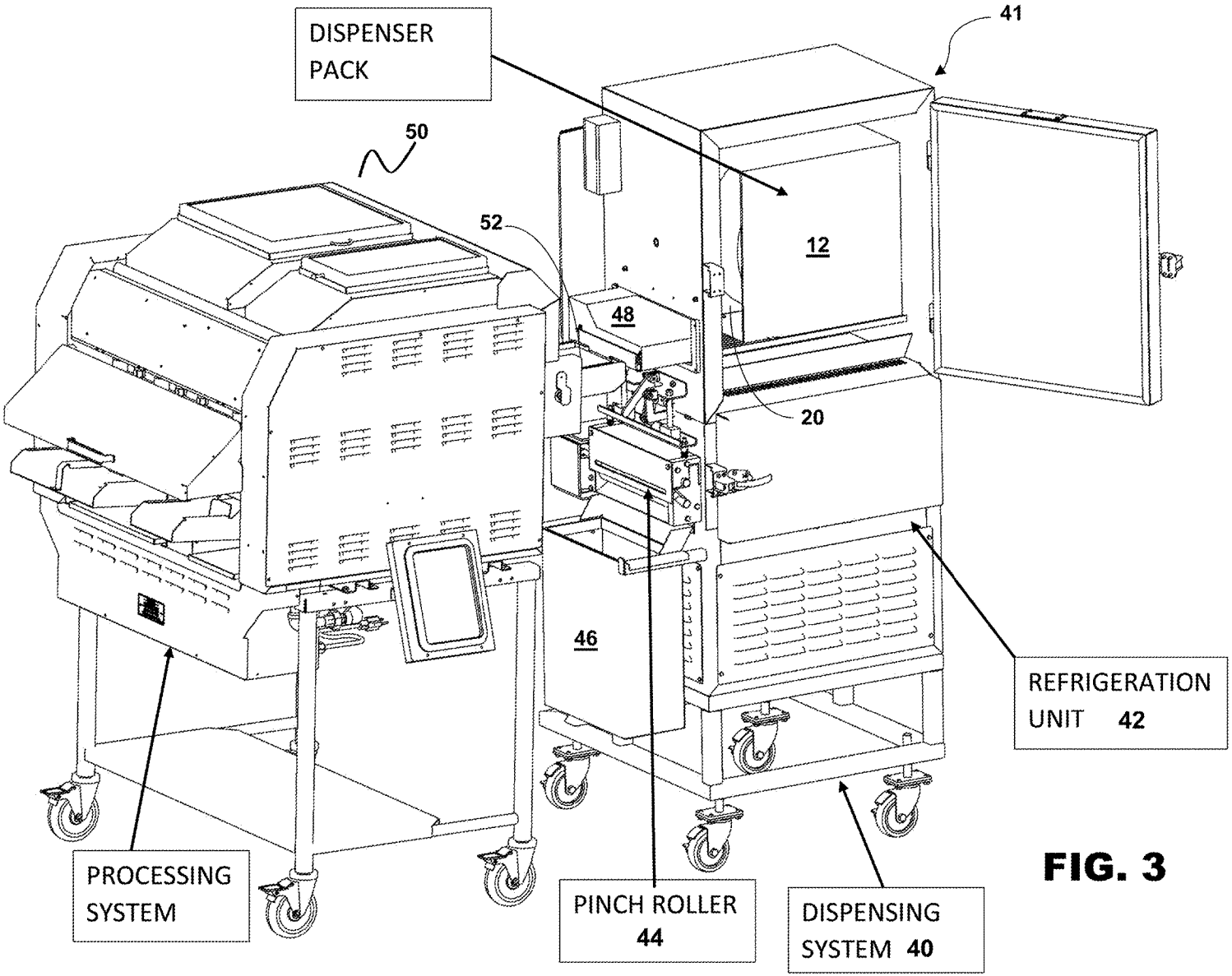
FIG. 3 is an oblique view of a dispensing system in accord with the present invention.

The structure and function of the Dispensing System is as follows:

Dispenser Packs 12 are loaded into the Dispensing System 40 of FIG. 3. The consumable belt 20 that is part of the Dispenser Pack 12 is threaded through the Dispensing System 40 at exit slot 48. The conveyer 20 and the food products 16 proceed downwardly onto a take up reel system 44, that preferably includes a pinch roller system. The threaded consumable belt 20 becomes a conveyor belt that presents the food products 16 to any sort of adjacent processing unit 50 that is required. The Dispensing System 40 meters out the food products 16 at a programmable rate. As the food products 16 get metered out they will transfer off the consumable belt and onto/into the separate processing unit 50 onto, for example, an intake feed conveyer 52 for the processing unit. The processing unit may be a system that cooks the food products.

The Dispensing System may include a refrigeration unit 42 that cools the upper compartment 41 where the Dispenser Packs 12 are placed for unwinding. The refrigeration unit 42 makes the Dispensing System a stand-alone device that can maintain the fresh food product 16 in ready to use condition.

The Dispensing System 40 has a sensor to sense when a Dispenser Pack 12 is empty. When the sensor detects an empty Dispenser Pack 12, the Dispensing System 40 signals an operator, or separate piece of automated equipment, to remove the empty Dispenser Pack 12 and the consumable belt 20 from the take up reel and empty, as necessary, the refuse collection box 46 positioned below the transfer point from the Dispenser System 40 to the processing system 50. The refuse collection box collects drips of food product 16 which may collect on and drop from the conveyer 20 as it is wound onto the take-up reel/pinch roller 44. A full Dispenser Pack 12 is then loaded into the refrigerated upper compartment 41, the conveyer 20 threaded through the Dispensing System 40 and the dispensing process begun again.

The Dispensing System 40 can have a plurality dispenser packs 12 that are controlled individually. The purpose of this feature is to have the ability to dispense different food products (i.e. beef, turkey, chicken, vegetable) from different Dispenser Packs at different speeds. Food products can be dispensed to single or multiple lanes for further processing.

I claim:

1. A food product gathering system, comprising:

a frame having a dispenser of a consumable conveyer mounted thereon, said consumable conveyer being fed in a single layer along an upward facing surface of a conveyer bed mounted on said frame, and adapted to convey thereon separately supplied individualized food product units toward a folding means for said conveyor, said folding means including a series of successively up-turned opposed finger elements engaging and, initially, lifting respective opposed edges of said conveyor to a vertical position and, thereafter, engaging successive upright legs of E-shaped finger elements, wherein each of said successive legs of E-shaped elements is inclined at progressively smaller angles to the conveyor bed, thereby folding said respective opposed conveyor edges one toward the other so as to form a longitudinally folded conveyor shape and folding said conveyor around said food product so as to form an unsealed tube encapsulating said food product, and at least one spool element configured to wind said folded consumable conveyer, with said food product units, onto said spool.

2. The food product gathering system as in claim 1, further comprising:

an element adapted for pivoting and having at least two mandrels mounted at each respective end of said element, each mandrel adapted to accept a spool thereon and configured to be placed into position one at a time to accept consumable conveyer material containing food product for winding on said spool.

3. The food gathering system as in claim 2, further comprising:

dispenser packs for containing spools loaded with food product units, and a robot for loading empty spools and removing loaded spools from said mandrels and transferring said loaded spools into an empty one of said dispenser pack containers for said spools.

4. The food gathering system as in claim 1, wherein:

the consumable conveyor comprises one of either a plastic film or a coated paper.

5. The food gathering system of claim 4, wherein:

the consumable conveyor is polyethylene film.

6. The system as in claim 1, wherein:

said food product are individualized fresh patties of food product.

7. The system as in claim 6, wherein:

the consumable conveyor material comprises one of either a food grade plastic film or a coated paper.

8. The system as in claim 7, wherein:

the consumable conveyor material is polyethylene film.

* * * * *